US009415319B1

(12) United States Patent
Jarrett et al.

(10) Patent No.: US 9,415,319 B1
(45) Date of Patent: Aug. 16, 2016

(54) MOTORCYCLE TRANSPARENT GLOBE TOY DEVICE

(71) Applicants: Stacy Jarrett, Fresno, CA (US); Kenneth Lewis, Fresno, CA (US)

(72) Inventors: Stacy Jarrett, Fresno, CA (US); Kenneth Lewis, Fresno, CA (US)

( * ) Notice: Subject to any disclaimer, the term of this patent is extended or adjusted under 35 U.S.C. 154(b) by 0 days.

(21) Appl. No.: 14/713,450

(22) Filed: May 15, 2015

(51) Int. Cl.

| | |
|---|---|
| ***A63H 17/00*** | (2006.01) |
| ***A63H 17/21*** | (2006.01) |
| ***A63H 17/26*** | (2006.01) |
| ***A63H 18/02*** | (2006.01) |
| ***A63H 30/04*** | (2006.01) |

(52) U.S. Cl.
CPC ..... *A63H 17/21* (2013.01); *A63H 17/264* (2013.01); *A63H 18/028* (2013.01); *A63H 30/04* (2013.01)

(58) Field of Classification Search
CPC ..... A63H 17/21; A63H 8/028; A63H 30/04
See application file for complete search history.

(56) References Cited

U.S. PATENT DOCUMENTS 7,988,520 B2 * 8/2011 Faanes ..... B44C 5/005 446/129

* cited by examiner

*Primary Examiner* — Michael Dennis
*Assistant Examiner* — Urszula M Cegielnik
(74) *Attorney, Agent, or Firm* — Crossley and Stevenson Intellectual Property Law

(57) ABSTRACT

The motorcycle transparent globe toy device provides a transparent globe within which at least one model motorcycle with rider is magnetically attracted to an interior surface via a plurality of ferrous particles. A remote controller for each motorcycle with rider dictates a speed of each. A plurality of arrangements of ferrous particles in the interior surface provides any number of patterns of a track system within the globe.

18 Claims, 4 Drawing Sheets

MOTORCYCLE TRANSPARENT GLOBE TOY DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

While motorized toys and especially motorized toys with remote radio frequency controls are known in the art, none provide the design and features of the present motorcycle transparent globe toy device.

FIELD OF THE INVENTION

The present motorcycle transparent globe toy device relates to toys, and more particularly to a toy device having hand held radio frequency operable motorcycles removably disposed within a transparent globe.

SUMMARY OF THE INVENTION

The general purpose of the motorcycle transparent globe toy device, described subsequently in greater detail, is to provide a motorcycle transparent globe toy device that has many novel features that result in a motorcycle transparent globe toy device which is not anticipated, rendered obvious, suggested, or even implied by prior art, either alone or in combination thereof.

To accomplish this, the motorcycle transparent globe toy device has a transparent globe having in interior surface. A lower opening is disposed in a lower center portion of the globe. A frustoconical base is provided. A battery pack is accessibly disposed within the base. An on/of switch is disposed in the base. A right circular cylinder is disposed atop the frustoconical base. A sleeve is disposed atop the right circular cylinder. The transparent globe is disposed atop the sleeve with the lower opening centered within the sleeve. A hinge is disposed on the transparent globe and the sleeve. The transparent globe pivots about the hinge to allow access to the interior surface.

A latch mechanism is disposed adjacent the lower opening on a portion of the transparent globe diametrically opposite the hinge. A lever release is disposed on the latch mechanism. The lever release is configured to release the transparent globe to pivotally open from the sleeve by the hinge.

A track system including a plurality of spaced apart ferrous particles is disposed within the interior surface. A use of spaced apart ferrous particles adds to the excitement of playing with the device due to greater visibility than might be had with a solid track system. The track system is not limited to only a shape and layout as is illustrated within. The track system is provided in a plurality of conceivable patterns. For example, the track system is selectively provided with only a horizontal loop. As further example, the track system is also selectively provided with only a vertical loop, and also with a combination of both the horizontal loop and the vertical loop, and an overlapping operational communication between the vertical loop and the horizontal loop. The track system is selectively provided in various conceivable patterns. The illustrated track system has a riser, an upper quadrant connecting track, a continuous horizontal loop, and a continuous vertical loop. The riser is disposed from proximal the lower opening and progresses upwardly to connect to an upper quadrant connecting track. The upper quadrant connecting track is connected to the horizontal loop. The vertical loop and the horizontal loop intersect in an approximate center of the interior surface.

A selectively included plurality of spaced apart interconnected lights is disposed within the track system. The lights are in operational communication with the battery pack. An on/off switch is disposed within the frustoconical base. The on/off switch is in operational communication with the battery pack and the plurality of spaced apart lights.

At least a pair of model motorcycles with riders is provided. The base shape is advantageous in stabilizing the device during rapid model motorcycle with rider deployment. Each model motorcycle with rider selectively has a forwardly disposed headlight. An energy source is accessibly disposed within each model motorcycle with rider. The energy source is in operational communication with the headlight. Each model motorcycle with rider has a motorized rear wheel and a freely turning front wheel spaced apart from the motorized rear wheel. An energy source is accessibly disposed within each model motorcycle with rider. The energy source is in operational communication with the headlight. A magnet is disposed within a lower portion of each model motorcycle with rider. Each model motorcycle with rider is configured to be selectively held to the track system via the magnet and the plurality of spaced apart ferrous particles. Each motorcycle with rider is inserted into the globe via the pivotally openable globe.

A radio frequency (RF) receiver is disposed within each model motorcycle with rider. The RF receiver is in operational communication with the motorized rear wheel and the energy source. At least a pair of RF controllers is provided. Each controller has a hand grip. A helmet is disposed atop the hand grip. An RF transmitter is disposed within the helmet. A radio having a radio antenna and a tuner is disposed within the helmet. A user of each RF controller is able to tune in a chosen radio station to be enjoyed during play with the device. A graduated speed control is disposed downwardly from the helmet and is selectively and graduatingly moved from a position distal the hand grip to a position proximal the hand grip. The position of the graduated speed control determines a speed of each of the model motorcycles with riders. Each RF transmitter is frequency mated to one of the RF receivers.

A controller energy source is disposed within the hand grip. The controller energy source is in operational communication with the RF transmitter, the radio, and the graduated speed control.

One way to use the motorcycles with riders is to place one motorcycle with rider on the riser. Another motorcycle with rider might be placed on the vertical loop. Users can then try to time their speed to avoid collisions between the motorcycles with riders. The ferrous particles can also circle the track system on the same horizontal loop or vertical loop. As noted above the track system might also be plotted within the transparent globe wherein loops are side-by-side. There are no designed limitations for a layout of the ferrous particles, such that globes are available with a plurality of track system designs.

Various components of the device are provided in more basic forms than what is illustrated. As example, the base is provided in a square and circular shape. The right circular cylinder is provided as hollow without the sleeve, and the globe hinged to the cylinder. The helmets are also provided without a radio.

Thus has been broadly outlined the more important features of the present motorcycle transparent globe toy device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
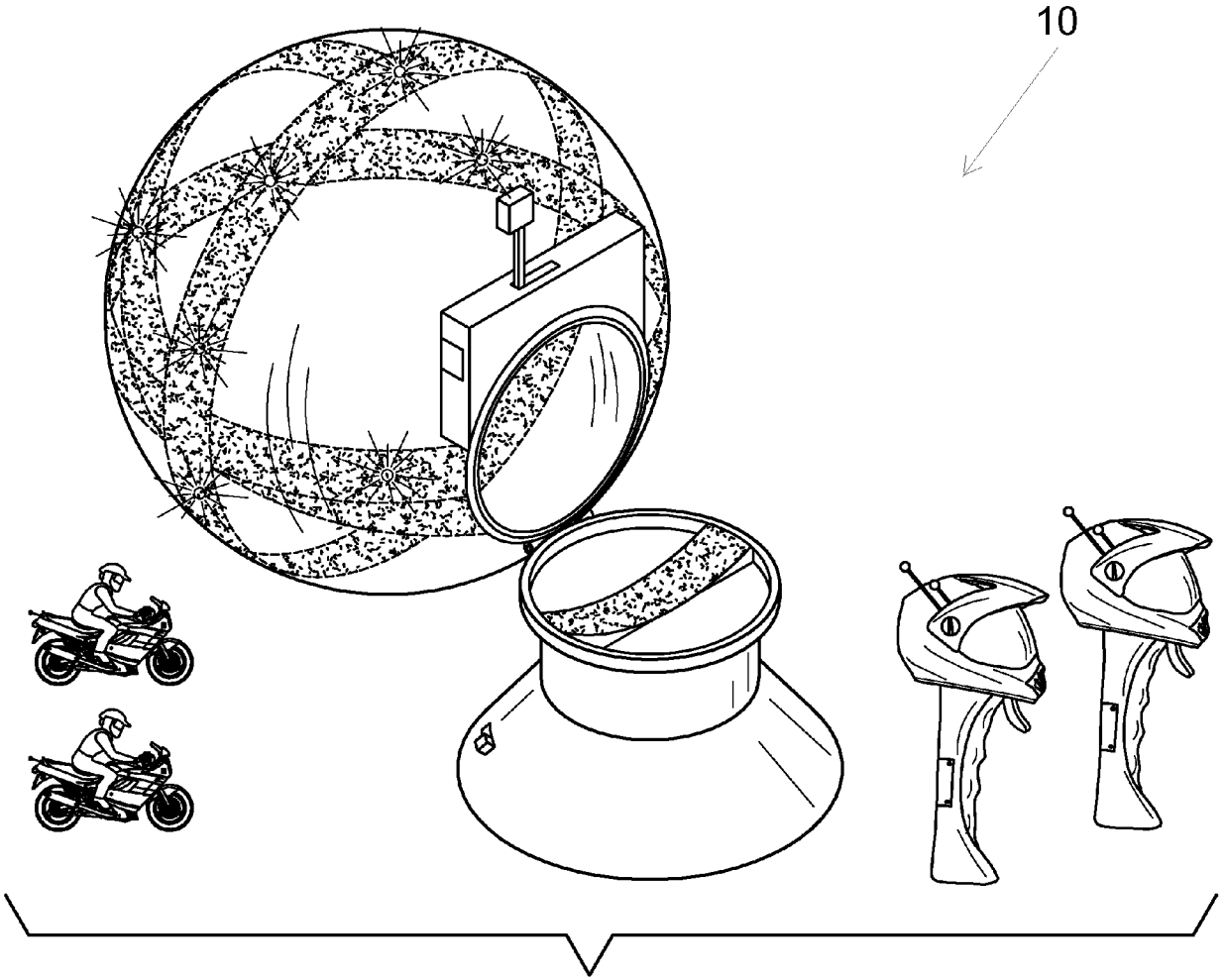
FIG. 1 is a perspective view.
Figure 2:
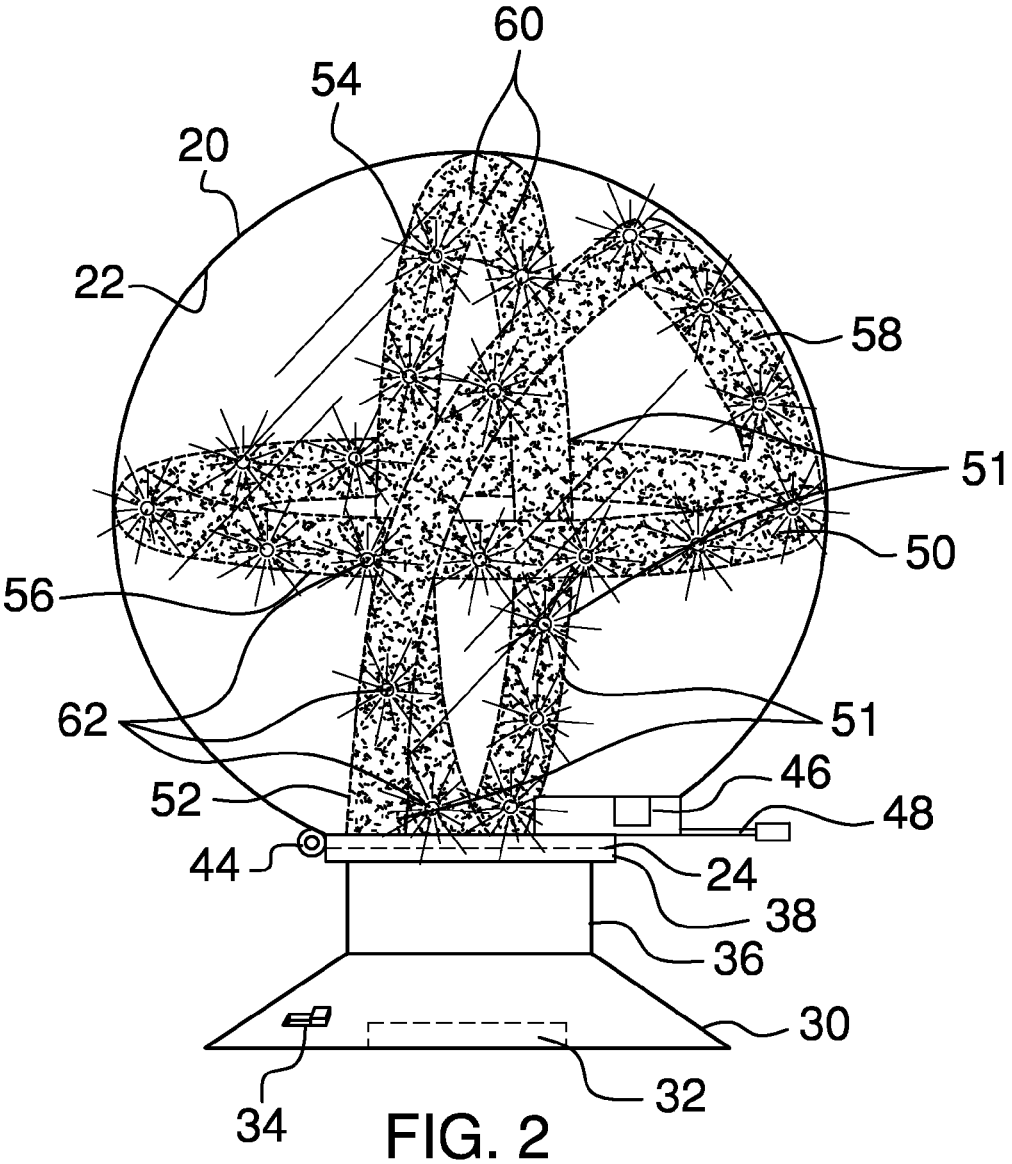
FIG. 2 is a lateral view of a globe hingedly opened above a sleeve.
Figure 3:
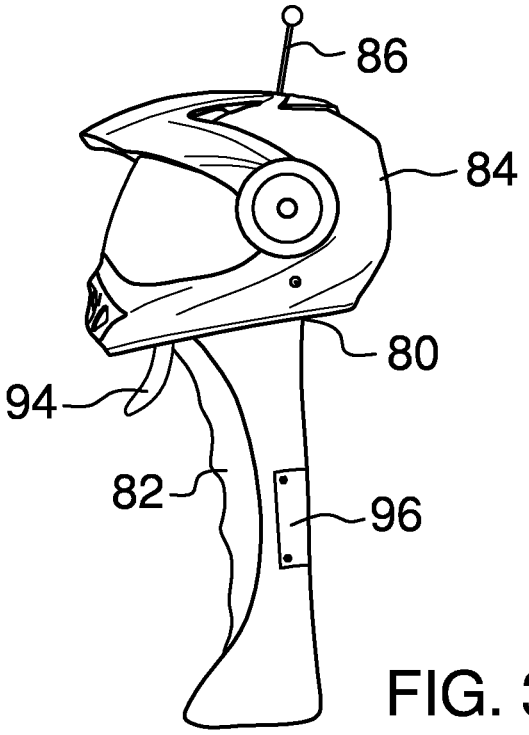
FIG. 3 is a side view of an RF controller.
Figure 4:
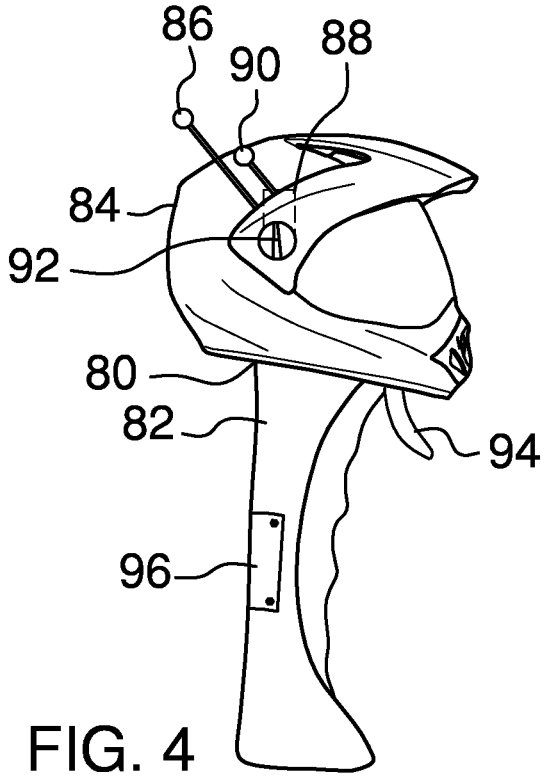
FIG. 4 is a side view of the RF controller opposite that of FIG. 3.
Figure 5:
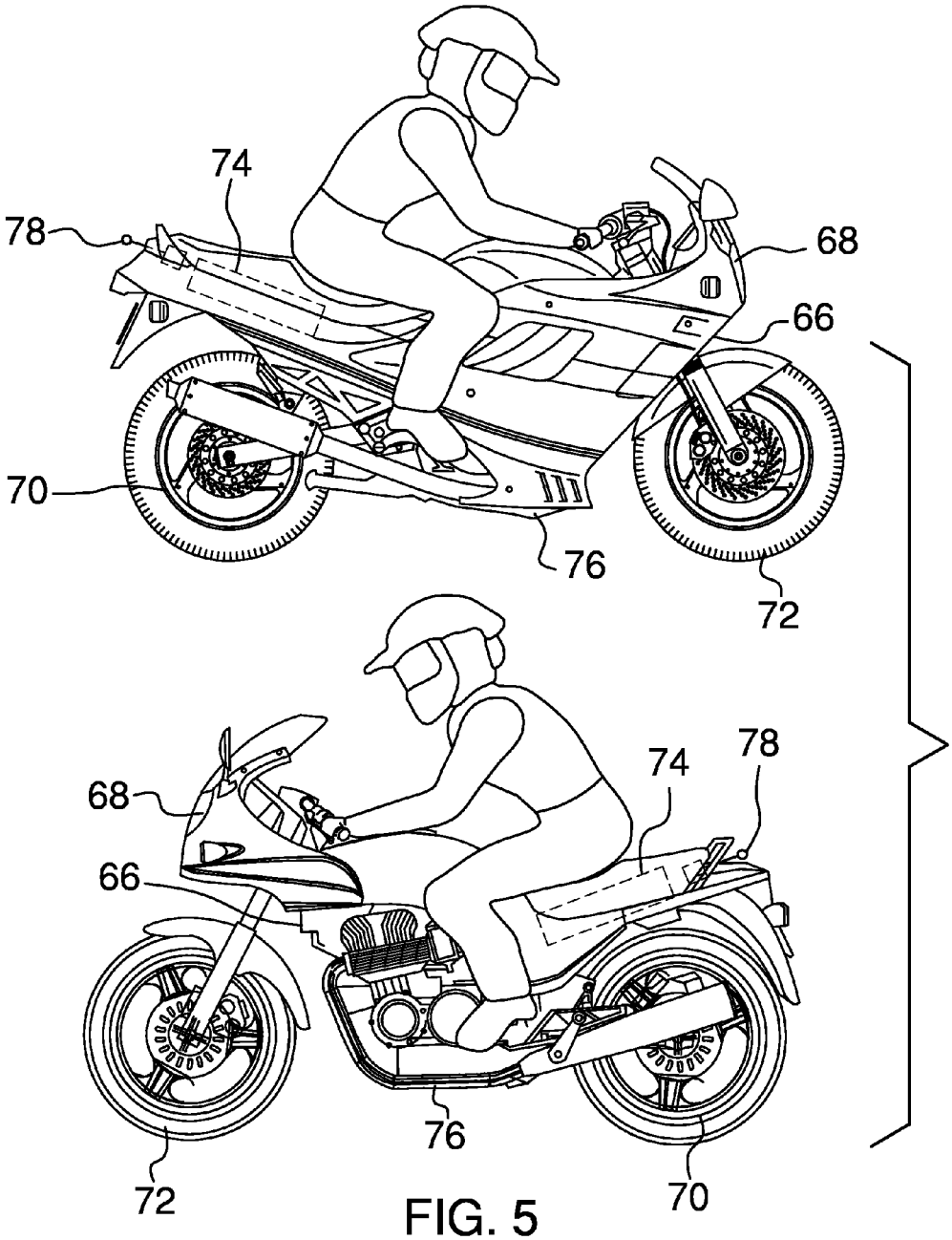
FIG. 5 is a side view of a model motorcycle with rider facing a right direction and, alternately, a left direction.

With reference now to the drawings, and in particular FIGS. 1 through 5 thereof, an example of the motorcycle transparent globe toy device employing the principles and concepts of the present motorcycle transparent globe toy device and generally designated by the reference number 10 will be described.

Referring to FIGS. 1 through 5, the motorcycle transparent globe toy device 10 has a transparent globe 20 having in interior surface 22. A lower opening 24 is disposed in a lower center portion of the globe 20. A frustoconical base 30 is provided. A battery pack 32 is accessibly disposed within the base 30. An on/of switch 34 is disposed in the base 30. A right circular cylinder 36 is disposed atop the frustoconical base 30. A sleeve 38 is disposed atop the right circular cylinder 36. The transparent globe 20 is disposed atop the sleeve 38 with the lower opening 24 centered within the sleeve 38. A hinge 44 is disposed on the transparent globe 20 and the sleeve 38. The transparent globe 20 pivots about the hinge 44 to allow access to the interior surface 22.

A latch mechanism 46 is disposed adjacent the lower opening 24 on a portion of the transparent globe 20 diametrically opposite the hinge 44. A lever release 48 is disposed on the latch mechanism 46. The lever release 48 is configured to release the transparent globe 20 to pivotally open from the sleeve 38 by the hinge 44.

A track system 50 including a plurality of spaced apart ferrous particles 60 is disposed within the interior surface 22. A pattern 51 of the track system 50 has a riser 52, an upper quadrant connecting track 58, a continuous horizontal loop 56, and a continuous vertical loop 54. The riser 52 is disposed from proximal the lower opening 42 and progresses upwardly to connect to the upper quadrant connecting track 58. The upper quadrant connecting track 58 is connected to the horizontal loop 56. The vertical loop 54 and the horizontal loop 56 intersect in an approximate center of the interior surface 22.

A plurality of spaced apart interconnected lights 62 is disposed within the track system 50. The lights 62 are in operational communication with the battery pack 32. An on/off switch 64 is disposed within the frustoconical base 30. The on/off switch 64 is in operational communication with the battery pack 24 and the plurality of spaced apart lights 62.

At least a pair of model motorcycles with riders 66 is provided. Each model motorcycle with rider 66 has a forwardly disposed headlight 68. An energy source 74 is accessibly disposed within each model motorcycle with rider 66. The energy source 74 is in operational communication with the headlight 68. Each model motorcycle with rider 66 has a motorized rear wheel 70 and a freely turning front wheel 72 spaced apart from the motorized rear wheel 70. An energy source 74 is accessibly disposed within each model motorcycle with rider 66. The energy source 74 is in operational communication with the headlight 68 and the motorized rear wheel 70. A magnet 76 is disposed within a lower portion of each model motorcycle with rider 66. Each model motorcycle with rider 66 is configured to be selectively held to the track system 50 via the magnet 76 and the plurality of spaced apart ferrous particles 60.

A radio frequency (RF) receiver 78 is disposed within each model motorcycle with rider 66. The RF receiver 78 is in operational communication with the motorized rear wheel 70 and the energy source 74. At least a pair of RF controllers 80 is provided. Each controller 80 has a hand grip 82. A helmet 84 is disposed atop the hand grip 82. An RF transmitter 86 is disposed within the helmet 84. A radio 88 having a radio antenna 90 and a tuner 92 is disposed within the helmet 84. A user of each RF controller 80 is able to tune in a chosen radio station to be enjoyed during play with the device 10. A graduated speed control 94 is disposed downwardly from the helmet 84 and is selectively moved from a position distal the hand grip 82 to a position proximal the hand grip 82. Such an alternately varied position of the graduated speed control 94 is configured to increase a flow of energy from the energy source 74 to the motorized rear wheel 70 wherein the model motorcycle with rider 66 increases speed.

A controller energy source 96 is disposed within the hand grip 82. The controller energy source 96 is in operational communication with the RF transmitter 86, the radio 88, and the graduated speed control 94.

What is claimed is:

1. A motorcycle transparent globe toy device comprising:

a transparent globe having in interior surface;

a lower opening disposed in a lower center portion of the globe;

a base;

a hollow right circular cylinder disposed atop the base;

a hinge disposed on the transparent globe and the right circular cylinder, wherein the globe is configured to pivot about the hinge to allow access to the interior surface;

a track system having a pattern, the track system comprising a plurality of spaced apart ferrous particles disposed on the interior surface;

a model motorcycle with rider having a motorized rear wheel and a freely turning front wheel spaced apart from the motorized rear wheel;

an energy source accessibly disposed within the model motorcycle with rider, the energy source in operational communication with the motorized rear wheel;

a magnet disposed within a lower portion of the model motorcycle with rider;

wherein the model motorcycle with rider is configured to be selectively held to the track system via the plurality of spaced apart ferrous particles and the magnet;

a RF receiver disposed within the model motorcycle with rider, the RF receiver in operational communication with the motorized rear wheel and the energy source;

a RF controller having:

a hand grip;

a helmet disposed atop the hand grip;

a RF transmitter disposed within the helmet;

a graduated speed control disposed downwardly from the helmet; and a controller energy source in operational communication with the RF transmitter, the radio, the graduated speed controller; alternately and graduatingly from to a position distal the hand grip to a position proximal the hand grip;

wherein a movement of the graduated speed control toward the handgrip is configured to increase a flow of energy from the energy source to the motorized rear wheel; and wherein the flow of energy determines a speed of the model motorcycle with rider.

2. The motorcycle transparent globe toy device of claim 1 having a radio, a radio antenna and a tuner disposed within the helmet, the radio in operational communication with the energy source.

3. The motorcycle transparent globe toy device of claim 1 having a headlight disposed within the model motorcycle with rider, the headlight in operational communication with the energy source.

4. The motorcycle transparent globe toy device of claim 2 having a headlight disposed within the model motorcycle with rider, the headlight in operational communication with the energy source.

5. The motorcycle transparent globe toy device of claim 1 wherein the track system pattern has a continuous horizontal loop.

6. The motorcycle transparent globe toy device of claim 2 wherein the track system pattern has a continuous horizontal loop.

7. The motorcycle transparent globe toy device of claim 3 wherein the track system pattern has a continuous horizontal loop.

8. The motorcycle transparent globe toy device of claim 4 wherein the track system pattern has a continuous horizontal loop.

9. The motorcycle transparent globe toy device of claim 1 wherein the track system pattern has a continuous vertical loop in operational communication with the horizontal loop.

10. The motorcycle transparent globe toy device of claim 2 wherein the track system pattern has a continuous vertical loop in operational communication with the horizontal loop.

11. The motorcycle transparent globe toy device of claim 3 wherein the track system pattern has a continuous vertical loop in operational communication with the horizontal loop.

12. The motorcycle transparent globe toy device of claim 4 wherein the track system pattern has a continuous vertical loop in operational communication with the horizontal loop.

13. The motorcycle transparent globe toy device of claim 5 wherein the track system pattern has a continuous vertical loop in operational communication with the horizontal loop.

14. The motorcycle transparent globe toy device of claim 6 wherein the track system has a continuous vertical loop in operational communication with the horizontal loop.

15. The motorcycle transparent globe toy device of claim 7 wherein the track system pattern has a continuous vertical loop in operational communication with the horizontal loop.

16. The motorcycle transparent globe toy device of claim 8 wherein the track system pattern has a continuous vertical loop in operational communication with the horizontal loop.

17. A motorcycle transparent globe toy device comprising:

a transparent globe having in interior surface;

a lower opening disposed in a lower center portion of the globe;

a frustoconical base;

a battery pack accessibly disposed within the base;

an on/of switch disposed in the base;

a right circular cylinder disposed atop the base;

a sleeve disposed atop the right circular cylinder, the globe disposed atop the sleeve, the lower opening centered within the sleeve;

a hinge disposed on the transparent globe and the sleeve, wherein the globe is configured to pivot about the hinge to allow access to the interior surface;

a latch mechanism disposed adjacent the lower opening on a portion of the transparent globe diametrically opposite the hinge;

a lever release disposed on the latch mechanism;

a track system having a pattern comprising a plurality of spaced apart ferrous particles disposed on the interior surface, the track system having:

a riser disposed from proximal the lower opening and continued upwardly;

an upper quadrant connecting track connected to the riser at an upper portion of the interior surface;

a continuous horizontal loop connected to the upper quadrant connecting track in an approximate center of the interior surface;

a continuous vertical loop, the vertical loop and the horizontal loop intersecting in an approximate center of the interior surface;

a plurality of spaced apart interconnected lights disposed within the track system, the lights in operational communication with the battery pack;

at least a pair of model motorcycles with riders, each one of the model motorcycles with riders having a motorized rear wheel and a freely turning front wheel spaced apart from the motorized rear wheel;

a headlight disposed forwardly in each model motorcycle with rider;

an energy source accessibly disposed within each model motorcycle with rider, the energy source in operational communication with the headlight and the motorized rear wheel;

a magnet disposed within a lower portion of each model motorcycle with rider;

wherein each model motorcycle with rider is configured to be selectively held to the track system via the plurality of spaced apart ferrous particles and the magnet;

a RF receiver disposed within each model motorcycle with rider, the RF receiver in operational communication with the motorized rear wheel and the energy source;

at least a pair of RF controllers, each of the controllers having:

a hand grip;

a helmet disposed atop the hand grip;

a RF transmitter disposed within the helmet;

a radio having a radio antenna and a tuner disposed within the helmet;

a graduated speed control disposed downwardly from the helmet; and a controller energy source in operational communication with the RF transmitter, the radio, the graduated speed controller alternately and graduatingly disposed from to a position distal the hand grip to a position proximal the hand grip;

wherein a movement of the graduated speed control toward the handgrip is configured to increase a flow of energy from the energy source to the motorized rear wheel; and wherein the flow of energy determines a speed of each model motorcycle with rider.

18. A motorcycle transparent globe toy device comprising:

a transparent globe having in interior surface;

a lower opening disposed in a lower center portion of the globe;

a frustoconical base;

a battery pack accessibly disposed within the base;

an on/of switch disposed in the base;

a right circular cylinder disposed atop the base;

a sleeve disposed atop the right circular cylinder, the globe disposed atop the sleeve, the lower opening centered within the sleeve;

a hinge disposed on the transparent globe and the sleeve, wherein the globe is configured to pivot about the hinge to allow access to the interior surface;

a latch mechanism disposed adjacent the lower opening on a portion of the transparent globe diametrically opposite the hinge;

a lever release disposed on the latch mechanism;

a track system having a pattern comprising a plurality of spaced apart ferrous particles disposed on the interior surface, the track system having:

a riser disposed from proximal the lower opening and continued upwardly;

an upper quadrant connecting track connected to the riser at an upper portion of the interior surface;

a continuous horizontal loop connected to the upper quadrant connecting track in an approximate center of the interior surface;

a continuous vertical loop, the vertical loop and the horizontal loop intersecting in an approximate center of the interior surface;

a plurality of spaced apart interconnected lights disposed within the track system, the lights in operational communication with the battery pack;

at least a pair of model motorcycles with riders, each one of the model motorcycles with riders having a motorized rear wheel and a freely turning front wheel spaced apart from the motorized rear wheel;

a headlight disposed forwardly in each model motorcycle with rider;

an energy source accessibly disposed within each model motorcycle with rider, the energy source in operational communication with the headlight and the motorized rear wheel;

a magnet disposed within a lower portion of each model motorcycle with rider;

wherein each model motorcycle with rider is configured to be selectively held to the track system via the plurality of spaced apart ferrous particles and the magnet;

a RF receiver disposed within each model motorcycle with rider, the RF receiver in operational communication with the motorized rear wheel and the energy source;

a pair of RF controllers, each of the controllers having:

a hand grip;

a helmet disposed atop the hand grip;

a RF transmitter disposed within the helmet;

a radio having a radio antenna and a tuner disposed within the helmet;

a graduated speed control disposed downwardly from the helmet; and a controller energy source in operational communication with the RF transmitter, the radio, the graduated speed controller; alternately and graduatingly from to a position distal the hand grip to a position proximal the hand grip;

wherein a movement of the graduated speed control toward the handgrip is configured to increase a flow of energy from the energy source to the motorized rear wheel; and wherein the flow of energy determines a speed of each model motorcycle with rider.

* * * * *